US005477505A

United States Patent [19]

Drumheller

[11] Patent Number: 5,477,505

[45] Date of Patent: Dec. 19, 1995

[54] DOWNHOLE PIPE SELECTION FOR ACOUSTIC TELEMETRY

[75] Inventor: Douglas S. Drumheller, Cedar Crest, N.M.

[73] Assignee: Sandia Corporation, Albuquerque, N.M.

[21] Appl. No.: 304,012

[22] Filed: Sep. 9, 1994

[51] Int. Cl.[6] ..... H04H 9/00

[52] U.S. Cl. ..... 367/82; 175/40; 166/250.01

[58] Field of Search ..... 367/82, 911; 175/40, 175/50; 166/250

[56] References Cited

U.S. PATENT DOCUMENTS

| | | | |
|---|---|---|---|
| 5,128,901 | 7/1992 | Drumheller | 367/82 |
| 5,303,203 | 4/1994 | Kingman | 367/75 |
| 5,377,161 | 12/1994 | Meehan | 367/82 |

OTHER PUBLICATIONS

Drumheller, D. S., "Acoustical Properties of Drill String," *J. Acoust. Soc. AM,* vol. 85, (3) pp. 1048–1064, (1989).

Drumheller, D. S., "Attenuation of Sound Waves In Drill Strings," *J. Acoust. Soc. Am,* vol. 94, (4), pp. 2387–2396, (1993).

*Primary Examiner*—J. Woodrow Eldred

*Attorney, Agent, or Firm*—George H. Libman

[57] ABSTRACT

A system for transmitting signals along a downhole string including a plurality of serially connected tubular pipes such as drill or production pipes, a transmitter for transmitting a signal along the string and a receiver for receiving the signal placed along the string at a location spaced from said transmitting means, wherein the pipes between the transmitter and the receiver are ordered according to length of tube to minimize loss of signal from said transmitter to said receiver.

7 Claims, 4 Drawing Sheets

DOWNHOLE PIPE SELECTION FOR ACOUSTIC TELEMETRY

The United States Government has rights in this invention pursuant to Department of Energy Contract No. DE-AC04-76DP00789 with American Telephone and Telegraph Company.

BACKGROUND OF THE INVENTION

This invention relates generally to a method for transmitting data along a drill string, and more particularly to a method for increasing the data capacity for transmitted data through a length ordered drill string.

Deep subterranean wells are typically drilled using drill strings assembled from 10 meter pipe sections connected end-to-end by heavy threaded tool joints. A drill bit is attached to a drill collar at the downhole end of the drill string, the weight of the collar causing the bit to bite into the earth as the drill string is rotated from the surface. Drilling mud or air is pumped from the surface to the drill bit through an axial hole in the drill string. This fluid removes the cuttings from the hole, provides a hydrostatic head which controls the formation of gases, provides a deposit on the wall to seal the formation, and sometimes provides cooling for the bit.

Communication of information to the surface from downhole sensors of parameters such as pressure, temperature, drilling direction, or formation is desirable. Various methods of communicating that have been tried with varying degrees of success include electromagnetic radiation through the ground formation, electrical transmission through an insulated cable, laser communication through a fiber optic cable, pressure pulse propagation through the drilling mud, and wave propagation through the metal drill string. Each of these methods have advantages and disadvantages associated with signal attenuation, ambient noise, high temperatures and compatibility with standard drilling procedures.

The most commercially viable of these methods has been the transmission of information by pressure pulses in the drilling mud. However, attenuation mechanisms in the mud limit the transmission rate to less then five bits per second.

Acoustic telemetry through the drill string has been the goal of the industry for 50 years. The idea of acoustic telemetry is to produce a modulated elastic waves at the bottom of the well and let it propagate up the drill string to the surface and extract the data from the signal at the surface. At first glance, such a system should work, as the steel drill string is an excellent conductor of sound. However, in practice, these systems do not work. The received signal often does not correspond to the transmitted signal, and working systems would be limited to a low transmission rate on the order of less than 10 Hz.

The theory of acoustic telemetry has been studied to provide an explanation for its unexpectedly poor performance. D. Drumheller, "Acoustical properties of drill string," J. Acoust. Soc. Am. 85, 1048–1064 (1989), analyzed a dispersion equation to determine that the group velocity of the distorted signal through a steel drill string has real roots only in spaced passbands.

The assembled drill string has periodically spaced discontinuities in cross-sectional areas attributed to the tool joints, which form roughly 5% of the length of the drill string and have a cross sectional area 5 times greater than the remainder of the drill string. In U.S. Pat. No. 5,128,901, Drumheller disclosed that the signal loss in a drill string is, in addition to attenuation, also a function of distortion caused by the drill string which was found to function as a comb filter having both stopbands with high attenuation and passbands with minimal attenuation. This behavior resulted from periodic reflections along the drill string at the joint collars. This patent disclosed that the frequency of the acoustic signal should be chosen to fall within the pass bands of the filter, and the signal also should be preconditioned to correct for the distortion.

D. Drumheller, "Attenuation Of Sound Waves In Drill Strings", J. Acoust. Soc. Am. 94 (4), October 1993, pgs 2387–2396, discussed the three types of elastic waves that dominate in acoustic transmission in a drill string at the desired frequency range of 1–2 Khz: extensional, torsional, and bending waves. Communication with bending waves is not feasible because they tend to be the slowest of the three waves and are dispersive even in uniform piping. However, both torsional and extensional waves are long compared to the 125 mm diameter of the common drilling pipe, and these waves tend not to be dispersive in uniform diameter pipe.

Extensional and torsional waves are partially reflected at each of the tool joints. The reflection coefficient of extensional waves depends upon the ratio of the cross-sectional areas while the reflection coefficient of the torsional waves depends upon the ratio of the polar moment of inertia of these cross-sectional areas. Consequently, torsional waves undergo stronger reflections at the tool joints. This is one of the primary reasons for preferring extensional waves as a means for communicating information from downhole to the surface.

SUMMARY OF THE INVENTION

It is an object of this invention to provide a method to improve the transmission of extensional waves transmitted along a drill string.

It is another object of this invention to provide a method to minimize the attenuation of a signal transmitted along a drill string from downhole to the surface where data is extracted from the signal.

Another object of this invention to enhance data rate of acoustic telemetry used in commercial drilling from 50 to 100 times that of present data rates.

Additional objects, advantages, and novel features of the invention will become apparent to those skilled in the art upon examination of the following description or may be learned by practice of the invention. The objects and advantages of the invention may be realized and attained by means of the instrumentalities and combinations particularly pointed out in the appended claims.

To achieve the foregoing and other objects, and in accordance with the purpose of the present invention, as embodied and broadly described herein, the present, invention may comprise a borehole string having an acoustic receiver spaced from an acoustic transmitter, the tubes of the string between the receiver and transmitter being ordered by length to maximize signal transmission.

BRIEF DESCRIPTION OF THE DRAWINGS

The accompanying drawings, which are incorporated in and form part of the specification, illustrate an embodiment of the present invention and, together with the description, serve to explain the principles of the invention.

DETAILED DESCRIPTION OF THE INVENTION

Figure 1:
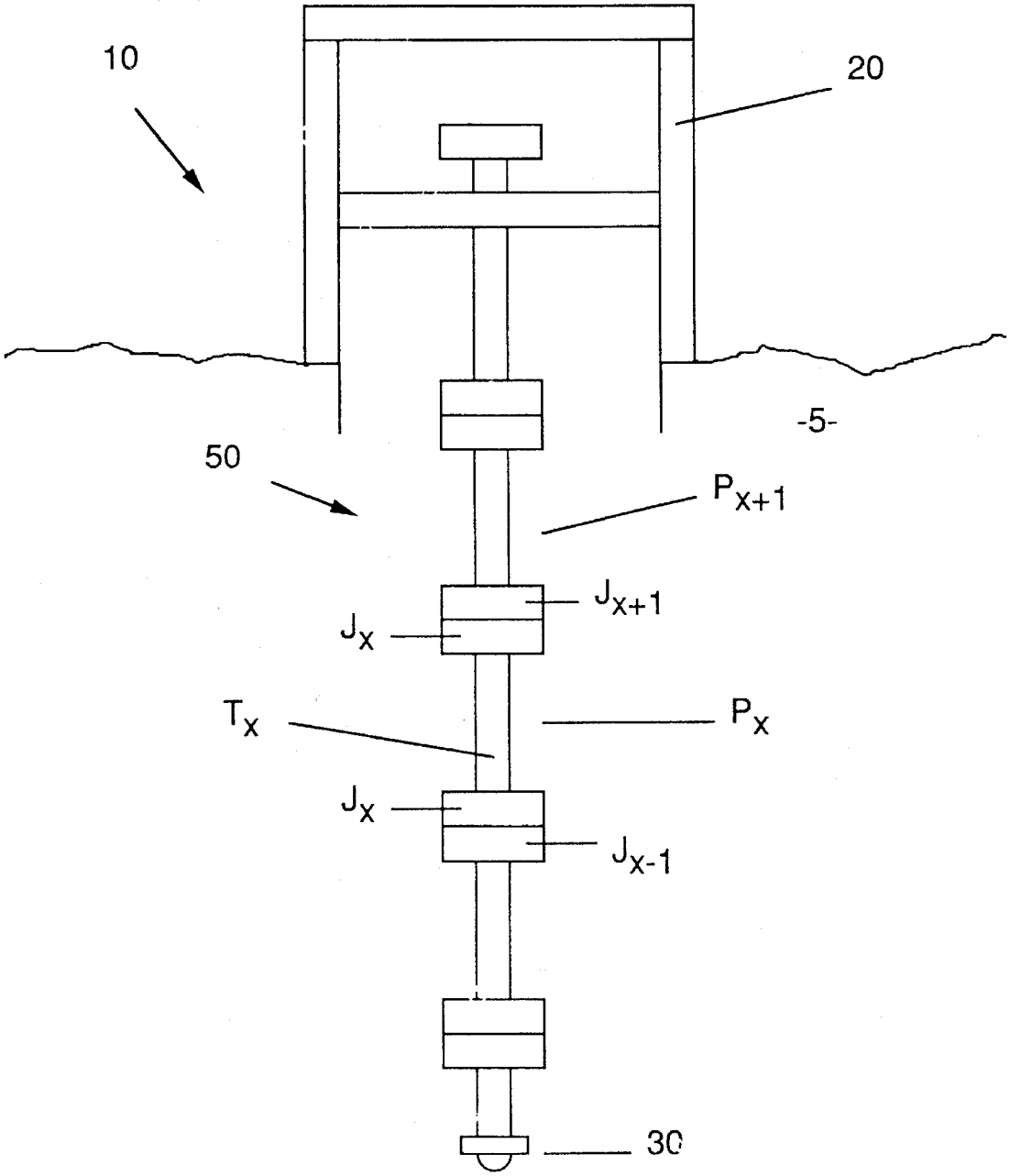
FIG. 1 shows a system a drill string.

As shown in FIG. 1, a preferred embodiment of this invention includes a system 10 for transmitting data along a drill string 50 extending into a borehole into the ground 5. Drill string 50 is supported at the surface and rotated by a conventional drilling structure 20 that also pumps drilling mud (not shown) into the hole and adds additional sections of drill pipe to drill string 50 in a manner that is well known in the art. Such conventional structure is not part of this invention. Drill string 50 also typically includes a tool 30, such as a weighted collar and a drill bit, at the downhole end. Conventional tool 30 is also not part of this invention.

As shown in FIG. 1, drill string 50 is formed of n sections of drill pipe, understood that the value of n increases each time a new section of drill pipe is added to drill string 50 at structure 20.

As each section of drill pipe is substantially similar to all other sections, a discussion of any section, such as $P_x$, also describes each other section. Drill pipe $P_x$ consists of a tube $T_x$ of relatively constant cross sectional area along its length, and a threaded coupling defining a tool joint $J_x$ at each end of the individual drill pipe for fastening drill pipe $P_x$ to adjacent drill pipes. Drill pipe tool joints conventionally comprise either a threaded male or a threaded female section so that $P_x$ can be threaded onto adjacent section $P_{x-1}$, and following section $P_{x+1}$, can be threaded onto section $P_x$. For the purpose of this invention it does not matter which coupler, male or female, is uphole.

Figure 3:
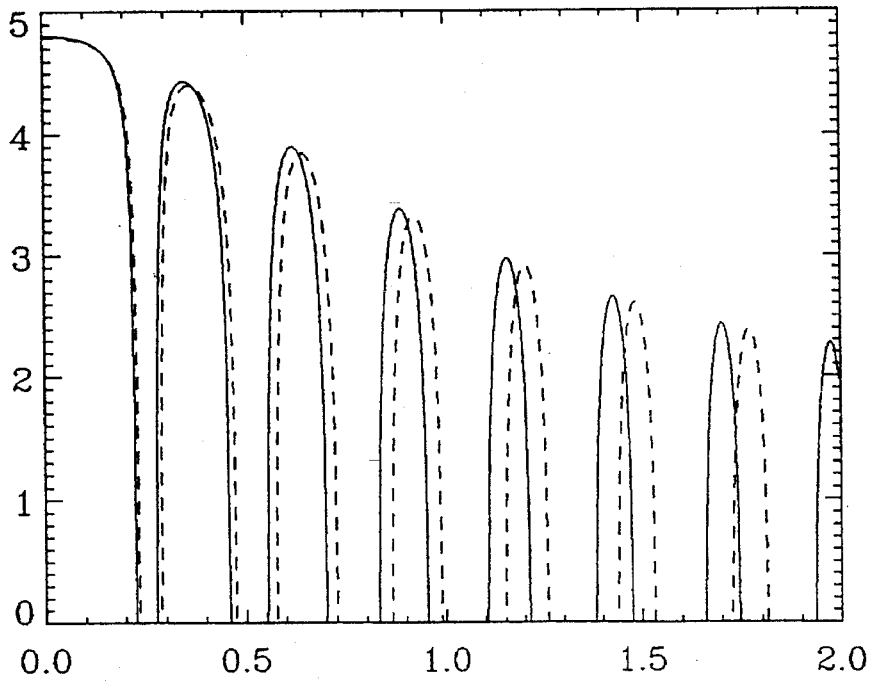
FIG. 3 shows calculated passbands for extensional waves along the drill string.

The formulation of this invention required an understanding of the effect of tube length on frequency transmission. FIG. 3 shows calculated passbands for extensional waves along a drill string where the length of each pipe is 10 meters, and another drill string where the length of each pipe is 9.5 meters. If a drill string is assembled from pipe of the original length and then connected to a string of shorter pipe, this comparison implies that only waves with frequencies located in passbands common to both pipe lengths will propagate the entire length of the drill string. In this example, all frequencies above 1.5 kHz would be blocked.

Figure 2:
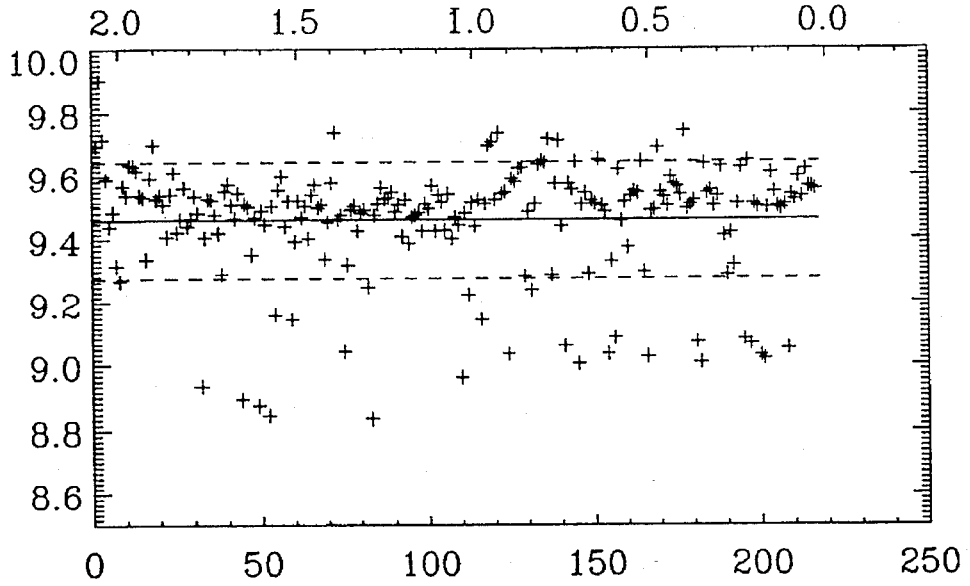
FIG. 2 shows lengths of individual drill pipe for a drill string.

Each actual drill pipe $P_x$ has a total length consisting of the length of tube $T_x$ and the lengths of joints $J_x$. The length of all joints is constant for different sections of pipe; however, there is considerable variation in the length of tubes T among different sections, because tube length is not accurately controlled during the manufacture of drill pipe. Current practice in the drilling industry today is to use both new and reconditioned drill pipe in drilling operations. FIG. 2 shows the distribution of pipe lengths as a function of position in an actual drill string that was utilized during the testing of this invention in a 2-km hole. Pipe lengths for this test ranged from approximately 8.8 meters to 9.9 meters.

The actual transmission characteristics of the drill string of FIG. 2 have been measured. Accelerometers mounted on the drill string at the surface measured extensional wave motion that was generated by an explosive device, commonly known in the drilling industry as a back-off shot, lowered into the well. Such a shot generates a broadband signal over the frequency range at issue. The drill string was filled with drilling mud for the tests.

Figure 4:
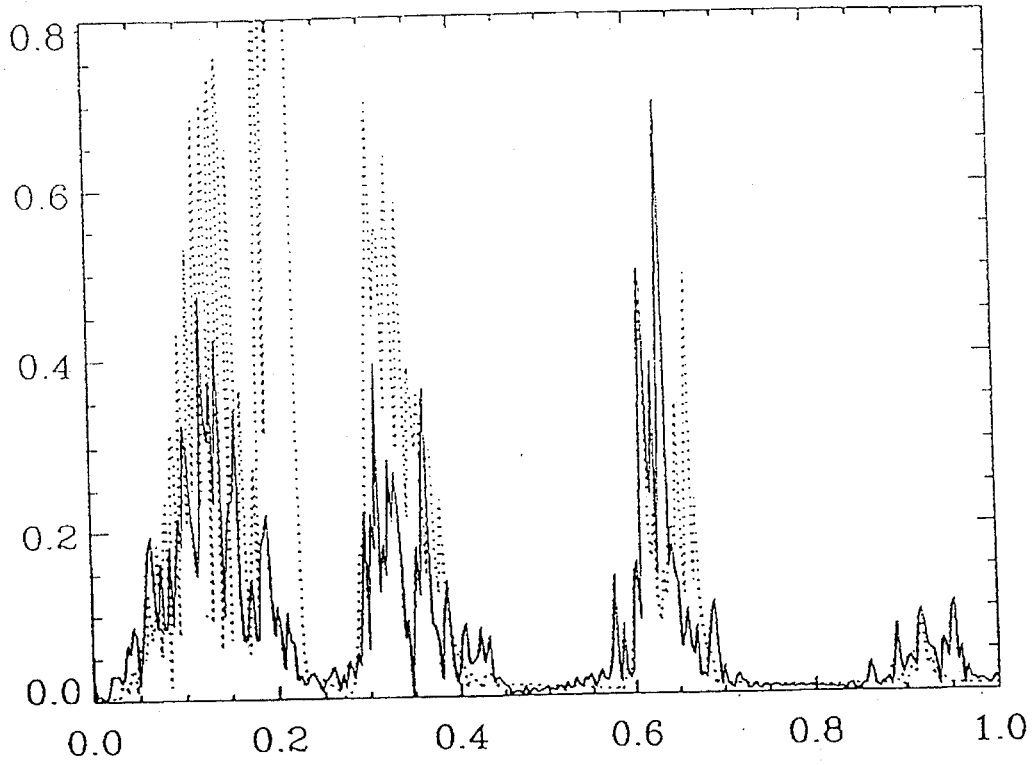
FIG. 4 shows acoustic properties of the drill string with no length order.

FIG. 4 shows amplitude as a function of frequency as provided by a Fourier transform of the calculated and measured data from a pulse through the drill string of FIG. 2. The length of the drill string was approximately 2 km; the back-off shot was detonated at a depth of 1.61 km; and the extensional wave was measured by an accelerometer at the surface. The calculated data was derived as discussed by Drumheller, J. Acoust. Soc. Am. 94 (4), referenced above and incorporated herein by reference, and accounted for the actual length of each section of the drill string.

Neither the calculations or the measured data exhibit significant amplitudes above 1 kHz at this depth. The transform of the calculated data shown by the dotted line deviates from the measured data in the passbands, most significantly in the first pass band at 200 Hz, while comparisons at the second through fourth passbands are good. The interference patterns within each passband are also well represented by the calculation. This test proved that the calculations provide a realistic simulation of the transmission of signals as extensional waves through a drill string.

As also set forth in the aforementioned Drumheller article, the calculated attenuation for this drill string peaks at about 520 Hz (at 15 db/km) and is much lower (below 5 db/km) above 1 kHz. Measured attenuation appeared to increase linearly with depth. The contradiction is explained by noting that the calculated levels were for extensional waves in a uniform pipe. The actual drill string has tool joints that produce reflections and thereby increase the effective propagation distance of the waves. The reflections typically manifest themselves as passbands and stop bands in the transmission spectrum.

These interference patterns within each passband provide the inspiration for this invention. It is know that interference spikes can be created even in perfectly periodic drill strings. This occurs in short drill strings where waves reflect and interfere off the end boundaries of the drill string; the number of spikes within each passband being related to the number of pipes in the drill string. However, in the present case, the drill string is too long and the attenuation is too high to allow the constructive and destructive interference of end reflections.

One possible source of this phenomena is the pipe length. If the drill string of FIG. 2 was length ordered, it would have the distribution shown in FIG. 5, with the shortest drill pipe is at the downhole end. FIG. 6 shows the Fourier transform of a calculated shot similar to the shot in FIG. 4 except on the length ordered drill string. As can be seen from the calculated data, there is a significant improvement in transmission, especially for higher passbands. This suggests that the number of reflections as well as the effective length of wave propagation can be reduced by eliminating the variations on the tool joint spacing. The analysis further predicts that these reflections can be reduced by simply rearranging the drill pipe according to length. When done, the interference patterns disappear from the calculated spectrum.

Figure 7:
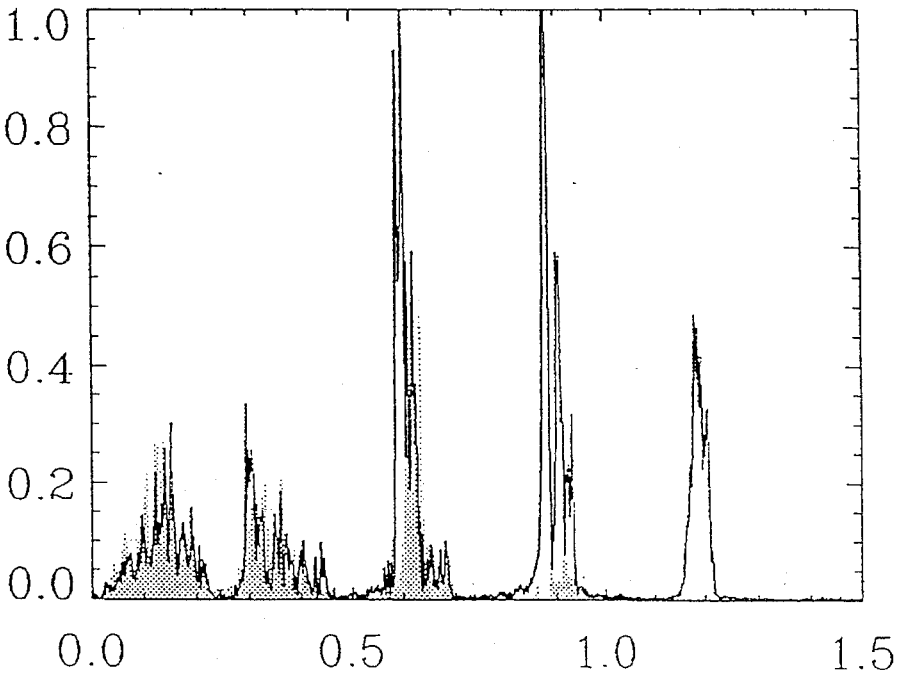
FIG. 7 shows actual acoustic properties of the drill string with length order.

FIG. 7 shows the measured data from a shot similar to FIG. 4 except on a length-ordered drill string. Additional casing was also added to the hole prior to the measured shot of FIG. 7, so the setup was not identical to that of the measured shot with unordered pipe. However, the measurements did substantially agree with the predicted results. The calculated and measured attenuation for the second through fifth passbands of the random and ordered drill strings of FIGS. 2 and 4 are as follows:

| | Drill String Attenuation (db/km) | | | |
|---|---|---|---|---|
| Pass Band Pipe Arrangement | Second | Third | Fourth | Fifth |
| Random | 12.3 | 18.8 | 27.8 | ∞ |
| Ordered (calculated) | 7.3 | 17.0 | 9.3 | ∞ |
| Ordered (measured) | 12.3 | 11.5 | 13.1 | 16.4 |

These results show that a noticeable improvement in higher frequency performance will result from the use of a length-ordered drill string.

In the tested embodiment, the pipes with the greatest variation in length from the majority of pipes were the shortest pipes. These pipes were placed in the hole first so their effect would be minimized except for shots at the maximum depth of the drill string.

In actual operation, generated signals are most likely to originate at the downhole end of the drill string. It also would be desirable to place the drill pipes with the least variation in length, in the instant case these would be the longer pipes, in the hole first, and decrease the pipe length as they are placed in the hole. This arrangement would provide the most accurate high frequency transmission while the hole is being drilled, and suffer the degradation caused by significantly shorter pipes only if they are used when the hole reaches its maximum depth.

Figure 5:
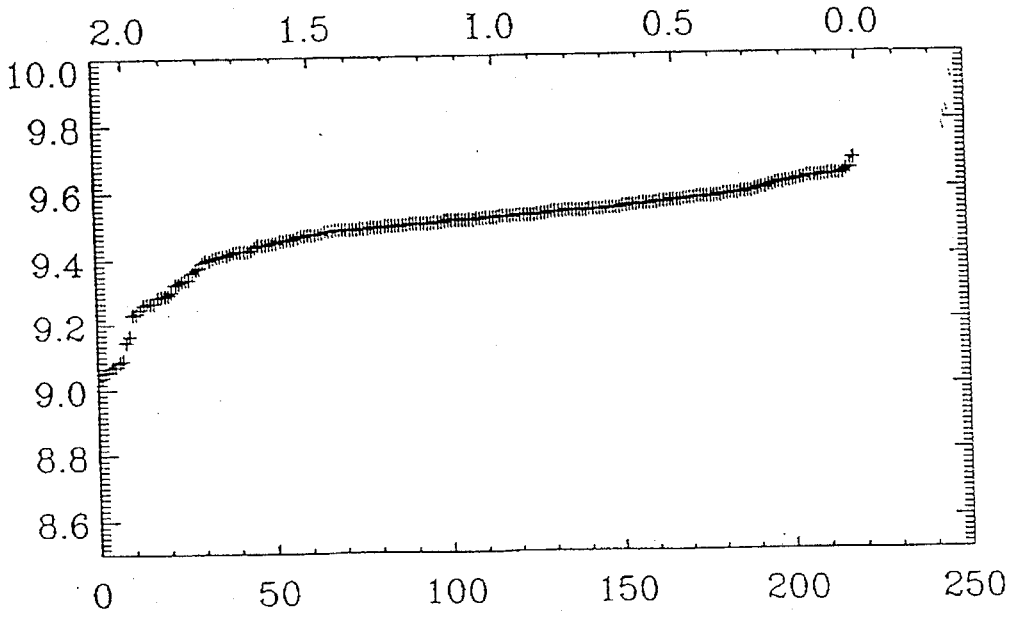
FIG. 5 shows length order of individual drill pipe for the drill string.
Figure 6:
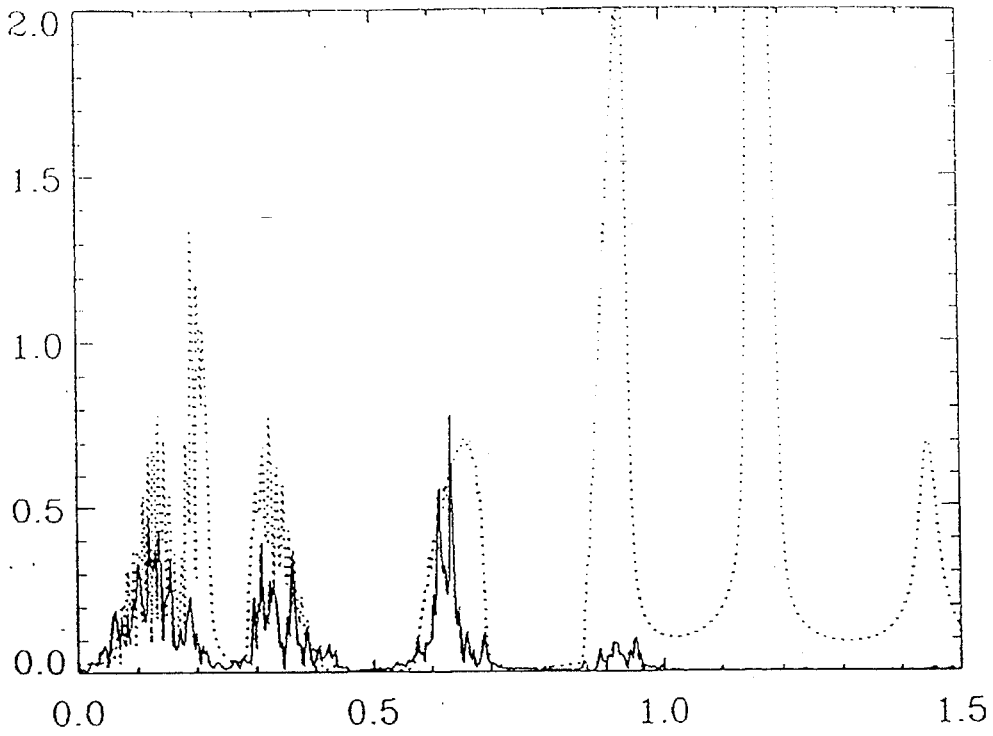
FIG. 6 shows calculated acoustic properties of the drill string with length order.

Since the distribution in FIG. 5 shows only a slight variation in pipe length for about ½ the pipes in the string (between about numbers 60 and 160), it is also contemplated by this invention that lengths of pipe that are relatively close to each other in length do not have to be ordered according to length; i.e., a few pipes being switched with other pipes of substantially the same length should not adversely effect the operation of the invention. This substantial ordering of pipes according to length will not work if pipes are not placed in the drill string adjacent to other pipes of substantially the same length.

Another embodiment of this invention to improve the transmission characteristics of a drill string uses drill pipe with a tight distribution of lengths. For the tests, the length of pipes varied ±0.5 m over the 10-meter nominal length of the pipe, a variation of about 10%. Calculations in the manner disclosed herein could provide a maximum range of lengths which would provide acceptable transmission performance for signals. Based on observations, the maximum allowable length variation for unordered pipes is about 0.5%. While this variation is much less than normal practice in the industry, it means that the 10-meter pipes should vary in length by no more than 50 mm, a precision that is easily attainable by the manufacturers of such pipes.

An obvious embodiment of this invention is to concentrate the energy of the data transmission into one of the passbands of the drill string. It is obvious to one skilled in the art that earlier attempts to develop acoustic telemetry systems failed because of the spreading of energy over broad band of frequencies, echoes dispersed the wave and diluted the energy, and the physical characteristics of the drill string blocked large bands of energy. The invention permits energy to be transmitted and received at higher passbands.

The particular sizes and equipment discussed above illustrate a particular embodiment of this invention. While the disclosure is directed towards a drill string, this invention may be used to transmit acoustical signals along any segmented tubular that is within a borehole and that is not acoustically damped by the sides of the borehole (such as casing). Production tubing, for example, is of thinner construction than drill string and has less massive couplings. Because of this construction, passbands to about 2.5 kHz are useable in production tubing, whereas passbands to only about 1 kHz are useable in drill strings. It is contemplated that the use of the invention may involve components having different sizes and shapes as long as the principle of ordering the segmented pipes in a drill string by length to maximize acoustic signal transmission is followed. It is intended that the scope of the invention be defined by the claims appended hereto.

We claim:

1. A method for transmitting acoustic signals along a segmented tubular string in a borehole, the string comprising a plurality of serially connected pipes, each pipe consisting of a length of tube of relatively uniform cross section having a joint means at each end, the length of the joint means of all pipes being relatively equal and the lengths of the tube of all pipes being a fraction of the length of the longest tube in the string, the method comprising transmitting a signal from a transmitter on the string and receiving the signal at a receiver on the string spaced from said transmitter, wherein the improvement comprises using pipes between the transmitter and receiver that have been arranged in order substantially according to length of tube to minimize loss of signal from said transmitter to said receiver.

2. The improved method of claim 1 wherein the longest tube is adjacent said receiver.

3. The improved method of claim 1 wherein the shortest tube is adjacent said receiver.

4. A method for transmitting acoustic signals along a segmented tubular string in a borehole, the string comprising a plurality of serially connected pipes, each pipe consisting of a length of tube of relatively uniform cross section having a joint means at each end, the length of the joint means of all pipes being relatively equal and the lengths of the tube of all pipes being a fraction of the length of the longest tube in the string, the method comprising transmitting a signal from a transmitter on the string and receiving the signal at a receiver on the string spaced from said transmitter, wherein the improvement comprises using pipes between the transmitter and receiver that have been selected to minimize the variation in length of the tubes within the string to minimize loss of signal from said transmitter to said receiver, the length of the shortest pipe being at least 99.5% of the length of the longest pipe.

5. The improved method of claim 4 wherein each pipe has a length on the order of 10 meters ±2.5 cm.

6. The improved method of claim 4 wherein said pipes are arranged in order according to length.

7. The improved method of claim 1 wherein said pipes are substantially ordered according to length, each pipe being adjacent other pipes of substantially the same length.

* * * * *